US007205496B2

(12) United States Patent
Schober et al.

(10) Patent No.: US 7,205,496 B2
(45) Date of Patent: Apr. 17, 2007

(54) SUB-MINIATURE SWITCH

(75) Inventors: Thomas Schober, Iber (DE); Stefan Reindl, Auerbach (DE)

(73) Assignee: Cherry GmbH, Auerbach/Opf. (DE)

( * ) Notice: Subject to any disclaimer, the term of this patent is extended or adjusted under 35 U.S.C. 154(b) by 0 days.

(21) Appl. No.: 11/262,096

(22) Filed: Oct. 28, 2005

(65) Prior Publication Data

US 2006/0118399 A1 Jun. 8, 2006

(30) Foreign Application Priority Data

Oct. 28, 2004 (DE) ..... 10 2004 052 413

(51) Int. Cl.
*H01H 3/12* (2006.01)

(52) U.S. Cl. ..... 200/329; 200/463

(58) Field of Classification Search ..... 200/329, 200/330, 441, 445, 448, 449, 450, 456–459, 200/461–467, 406, 407
See application file for complete search history.

(56) References Cited

U.S. PATENT DOCUMENTS 2,508,040 A * 5/1950 Ransome ..... 200/453
3,735,080 A * 5/1973 Andresen ..... 200/451
3,996,435 A * 12/1976 King ..... 200/463
4,636,597 A * 1/1987 Menche ..... 200/438
4,983,794 A * 1/1991 Kokubu ..... 200/461
5,453,590 A * 9/1995 Mayer ..... 200/461
5,459,295 A * 10/1995 Ohta et al. ..... 200/461
5,661,274 A * 8/1997 Koehler ..... 200/16 R

FOREIGN PATENT DOCUMENTS

EP 618603 7/1996
GB 2142471 1/1985

* cited by examiner

*Primary Examiner*—Elvin Enad
*Assistant Examiner*—M. Fishman
(74) *Attorney, Agent, or Firm*—Jordan and Hamburg LLP

(57) ABSTRACT

The invention relates to a sub-miniature switch including a housing, an actuator and terminals. The actuator protrudes from the housing at a position offset from the center of the housing. The terminals are electrically conductively coupled with fixed contacts (positioned within the housing). A contact maker is moved via the actuator and held in a first or second switching position by means of a bistable spring arrangement. An additional component, a separator or auxiliary actuator, is in snap-fit engagement with or clamped or glued in the cover of the housing and is pushed through by the actuator as the switch is operated. According to the present invention, the contact point of the fixed contacts is on a side of the housing which is opposite the actuator. The separator or auxiliary actuator is moved in the direction of the contact position by the actuator. Thus a structurally simple forced-opening capability is provided for the sub-miniature switch.

4 Claims, 4 Drawing Sheets

SUB-MINIATURE SWITCH

BACKGROUND OF THE INVENTION

The present invention relates to a sub-miniature switch of a type which is known in the state of the art, in particular from EP 618 603 B1 and GB 2 142 471 A.

The sub-miniature switches according to the prior art have a housing with a cover, an actuator protruding from the housing, and external terminals. The actuator is offset from the center of the housing. The terminals are connected in an electrically conducting way with fixed contacts positioned inside the housing. A moveably supported, in particular rotatably supported, contact maker can take up two positions depending on the position of the actuator. In both the first and second switching positions, the contact maker is held by a bistable spring arrangement (tension spring).

An additional component, a hold-down plate or separator or auxiliary actuator is provided in the housing, which is pushed through by the actuator as it is switched over from the first switching position to the second switching position. In the prior art, the auxiliary actuator is supported at the actuator.

Such sub-miniature switches are used in the industrial field in tube motors of roller blind drives or roller sun visor drives in order to sense the end-of-travel positions of the roller blind or sun visor. Stringent requirements are put on these micro-switches with respect to their operating safety and service life. The capacitive loads on the contacts in the end-of-travel positions easily lead to sticking or fusing of the contacts. The normal contact release force exerted by the tension spring of the bistable spring arrangement no longer suffices to pull away the stuck contact. This can lead to the destruction of the drive as it is not switched off. In order to avoid this it has to be ensured that the contact to be opened is mechanically opened after a defined travel distance of the actuator despite sticking of the contacts.

For this purpose, additional separators are known. Due to the addition of a component, the manufacture and assembly of these micro-switches is made more complex.

It is an object of the present invention to provide a sub-miniature switch of the type initially mentioned with a structurally simple and reliable forced-opening capability without increasing the structural size.

SUMMARY OF THE INVENTION

The approach according to the present invention is characterized in that the separator or auxiliary actuator is fixed in a cover of the housing and in that the separator or auxiliary actuator is moved by the actuator precisely in the direction of the contact point. As a rule, the separator is snapped into engagement with the cover of the housing. However, the separator can also be clamped or glued to the cover. The cover is configured in such a way that it can absorb a deflection of the separator. A transverse strut at the level of the contacts is mounted between the supporting position in the cover and the application position of the actuator. When the separator is pushed down on the contact maker by the actuator, the transverse strut tears open any fusing of the so-called NC contact.

This approach is simpler than the known solutions of the prior art and enables a forced opening to be effected at this contact point in the case of a fusion of the so-called NC contact, wherein the separator directly contacts the contact maker and causes the fused contacts to tear open by the application of a force which is parallel to the direction of movement.

BRIEF DESCRIPTION OF THE DRAWINGS

In the following, an exemplary embodiment of the present invention will be explained in more detail, in which.

DETAILED DESCRIPTION OF THE INVENTION

Figure 1:
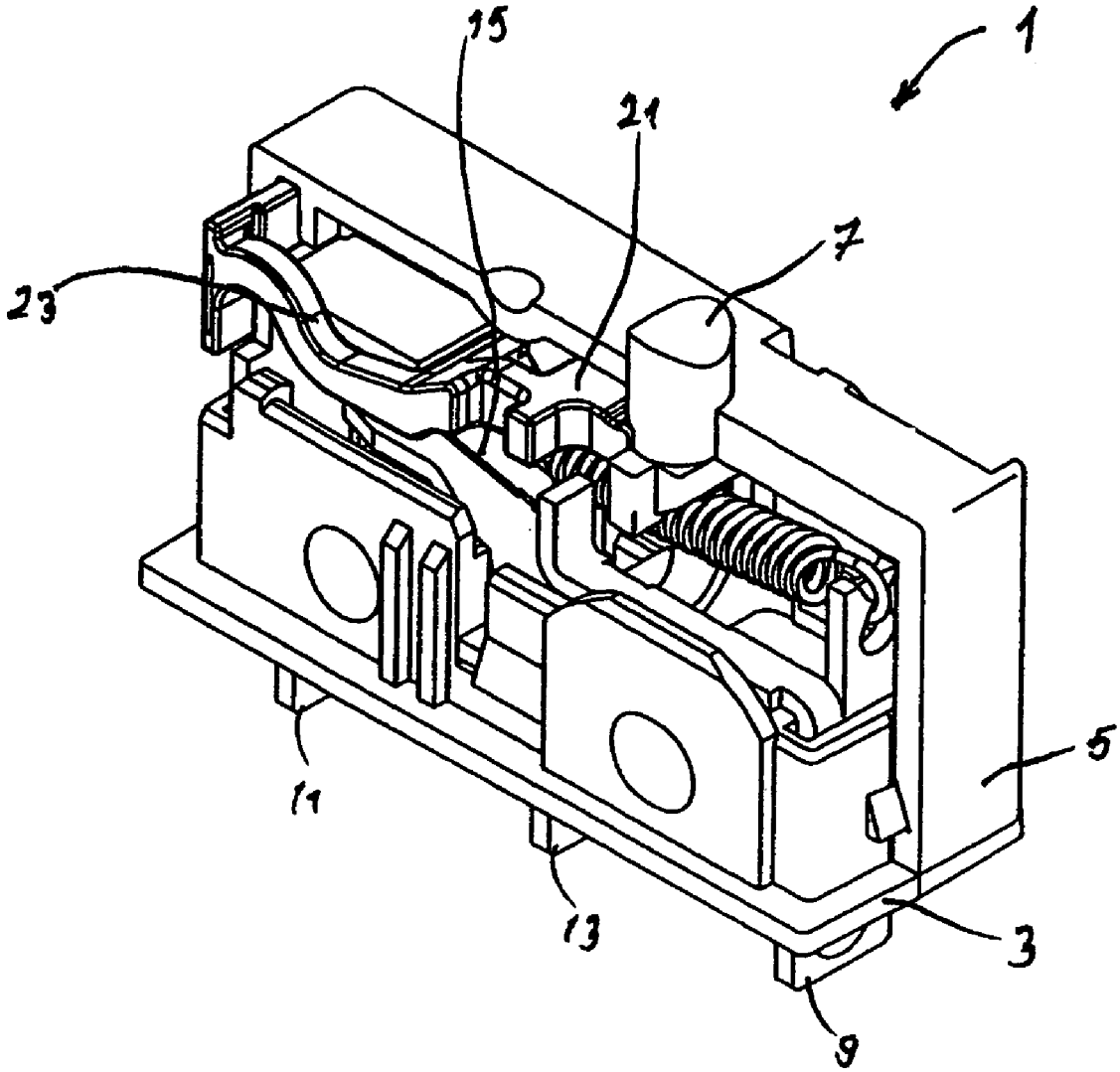
FIG. 1 is a view of the sub-miniature switch including a separator and an actuator.

In the perspective view according to FIG. 1, the sub-miniature switch 1 can be seen with the actuator 7 at the top and the contact tabs or terminals 9, 11 and 13 at the bottom. The structure is supported on the base 3 of the housing from which the terminals 9, 11 and 13 protrude downwards. Only half of the cover 5 of the housing is shown.

In this type of micro-switch, the actuator 7 is not centrally positioned, but offset to the right (in the present example). Via a tension spring 19, the actuator 7 pushes on a contact maker 15, which is moveably (in particular pivotably) supported and has two contacts 17 at its moveable end. The blade of the contact maker 15 is electrically connected to a common terminal 9 via a contact support (not shown). The contacts 17 form contact points with fixed contacts 24 and 27. The top fixed contact 24 is electrically connected to the terminal 11 via a connecting conductor 25; the bottom fixed contact 27 is correspondingly connected to the terminal 13.

Figure 2:
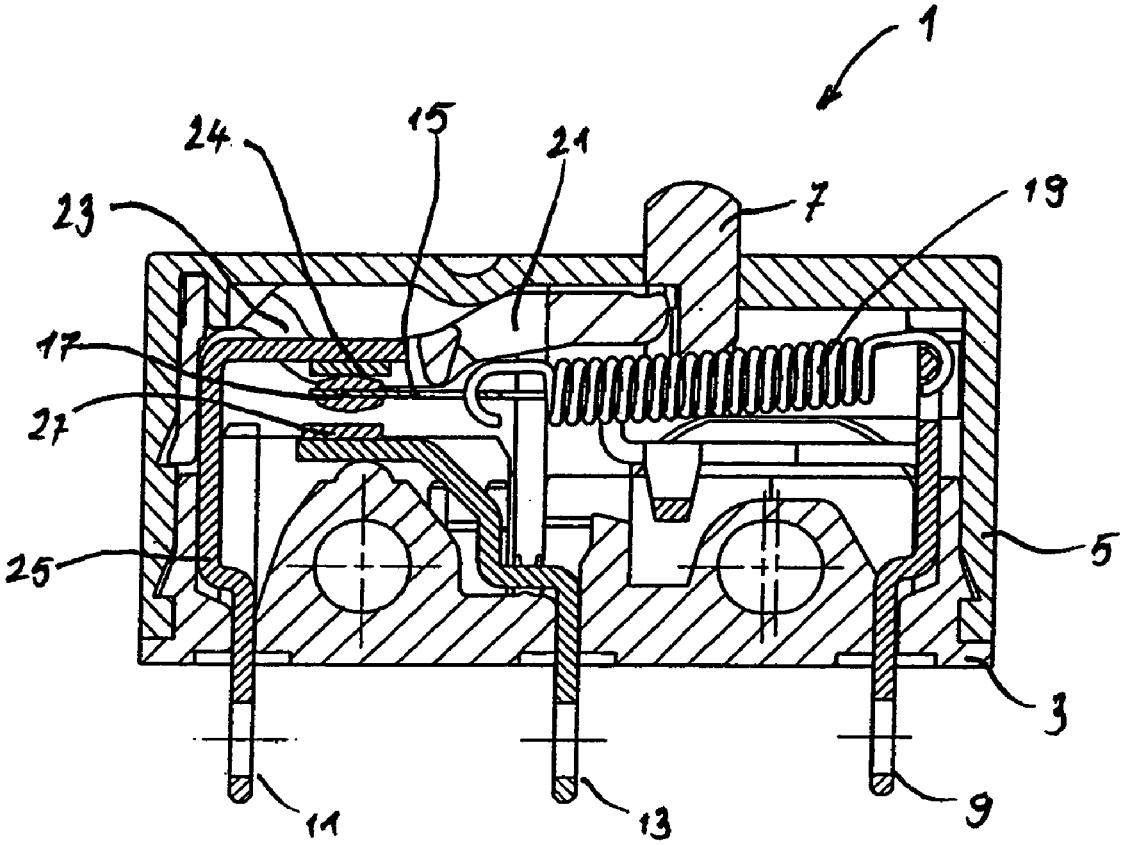
FIG. 2 is a sectional view of the micro-switch in the starting position of the actuator.

In the sectional view of FIG. 2, the actuator 7 is shown in its starting position. The tension spring 19 and the contact maker 15 are configured as a bistable spring arrangement and stabilize the contact maker 15 initially in a top contacting position (initial position of the actuator 7 in FIG. 2) and stabilize the contact maker 15, according to FIG. 4, in a bottom contacting position (end-of-travel position of the actuator 7).

As initially described, the contact maker 15 in the contact position shown in FIG. 2 tends to fuse with or stick to the fixed contact 24. By an additional component, the separator or auxiliary actuator 21, the terminal 11 (NC contact) is mechanically assisted when the contact is opened. Upon operation, the actuator 7 also engages the auxiliary actuator 21. The separator 21 then presses on the contact maker 15 in the area of the fixed contacts 24, 27 via a transverse strut 23 in order to tear away the contact maker 15. As shown in FIG. 1, the auxiliary actuator 21 is fixed to the housing cover 5 at its left-hand side. On its right-hand side the separator 21 is moveable and can assist in opening the mechanical contact by means of its transverse strut 23.

Figure 3:
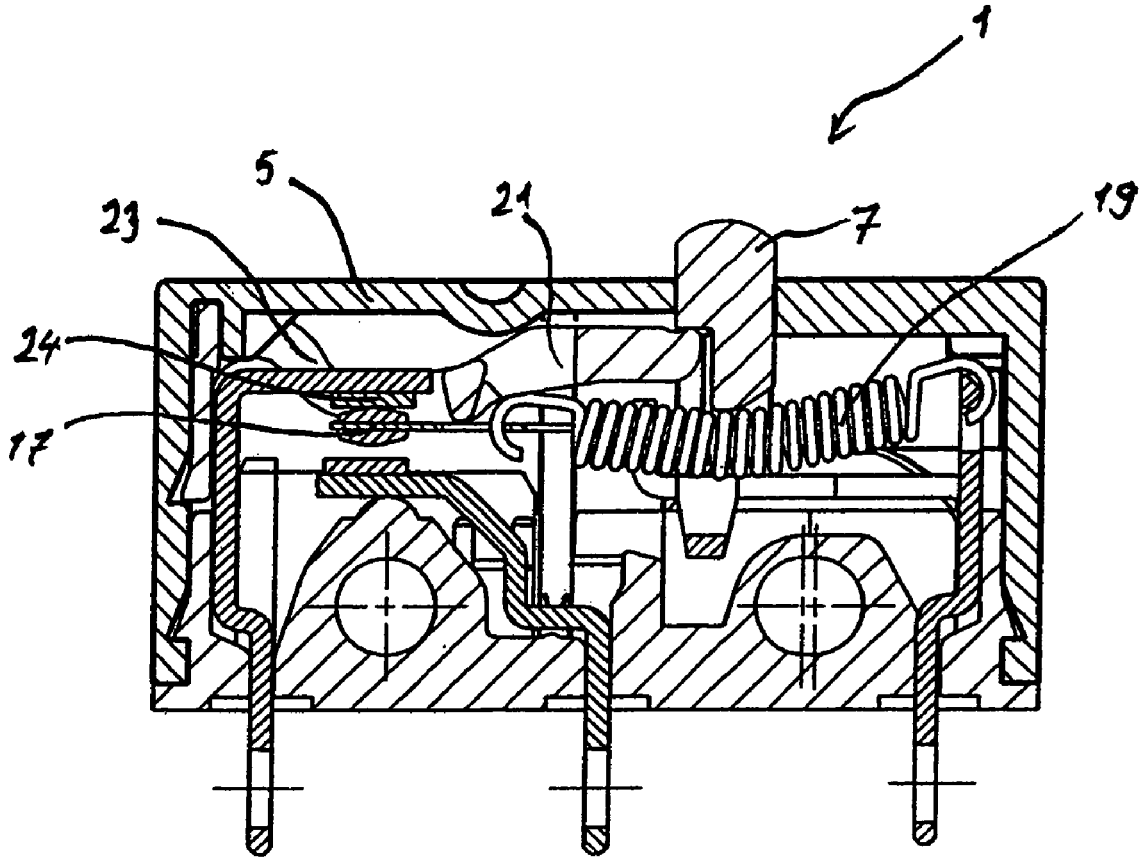
FIG. 3 is a view of the micro-switch with fused contacts, wherein the separator engages the contact maker.
Figure 4:
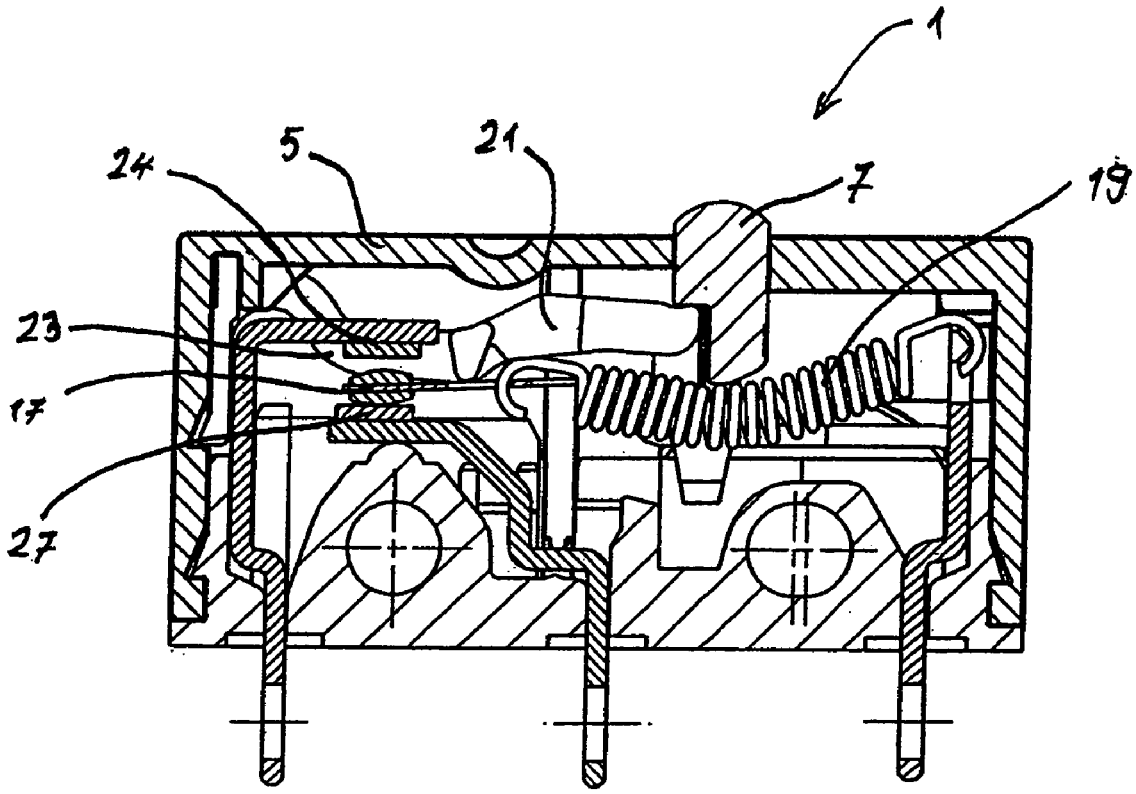
FIG. 4 is a sectional view of the micro-switch in the end position of the actuator.

FIG. 3 shows an intermediate situation in which the actuator has not yet reached its end position according to FIG. 4. But the tension spring 9 has already started releasing the contact. FIG. 3 shows the phase in which the transverse strut 23 of the separator 21 comes into assisting engagement.

LIST OF REFERENCE NUMERALS

1 sub-miniature switch or micro-switch
3 housing base
5 housing cover
7 actuator
9 common terminal COM
11 NC terminal
13 NO terminal
15 moveably supported contact maker
17 contacts of contact maker 15
19 tension spring of a bistable spring arrangement
21 separator or auxiliary actuator
23 transverse strut of separator 21
24 fixed contact of terminal 11
25 connection line from terminal 11 to fixed contact 24
27 fixed contact of terminal 13

The invention claimed is:

1. A sub-miniature switch, comprising a housing comprising a cover;

a first actuator offset with respect to a center of the housing and protruding therefrom, said actuator being normally in a first position and capable of being biased toward a second position;

a plurality of fixed contacts disposed within the housing, the fixed contacts being arranged on a side of the housing opposite the actuator;

a plurality of terminals, each terminal respectively electrically conductively connected to one of said fixed contacts;

a plurality of movable contacts, each capable of contacting one of said fixed contacts;

a contact maker moveably supporting said movable contacts;

a bistably arranged spring directly contacting said first actuator and capable of biasing the contact maker in a first switching position when said actuator is in said first position and capable of biasing said contact maker towards a second switching position when said actuator is biased towards said second position;

wherein a first of said movable contacts is biased against a first of said fixed contacts when said contact maker is in said first switching position and a second of said movable contact is biased against a second of said fixed contacts when said contact maker is in said second switching position;

a separator movably disposed in the cover of the housing and capable of directly contacting both said first actuator and said contact maker; and said separator biasing said contact maker away from said first switching position and towards said second switching position in response to said first actuator being biased towards said second position whereby the contact maker is biased towards said second switching position, the separator thereby functioning as an auxiliary actuator.

2. The sub-miniature switch according to claim 1, wherein the separator includes an end which is free to move and he separator further comprises a strut a portion of which in a lengthwise direction of the strut is spaced transversely from other portions of the separator, the engagement of the separator with the contact maker occurring by engagement of an area on the strut with an area on the contact maker adjacent the moveably supported contacts.

3. The sub-miniature switch according to claim 1 or 2, wherein the separator is in snap-fit engagement in the cover.

4. The sub-miniature switch according to claim 1 or 2, wherein the separator is clamped in the cover.

* * * * *